United States Patent [19]

Fletcher

[11] 4,011,853

[45] Mar. 15, 1977

[54] ARCHERY PEEP SIGHT

[76] Inventor: James D. Fletcher, P.O. Box 218, Bodfish, Calif. 93205

[22] Filed: July 31, 1975

[21] Appl. No.: 600,609

[52] U.S. Cl. ..... 124/87; 33/265; 124/90

[51] Int. Cl.[2] ..... F41B 5/00

[58] Field of Search ..... 124/30 A, 24 R, 23 R, 124/30 R, 90, 87; 33/265

[56] References Cited

UNITED STATES PATENTS

| | | | |
|---|---|---|---|
| 3,410,644 | 11/1968 | McLendon | 124/30 A |
| 3,859,733 | 1/1975 | Chesnick | 33/265 |
| 3,866,592 | 2/1975 | Carella | 124/24 R |

*Primary Examiner*—Richard C. Pinkham
*Assistant Examiner*—William R. Browne

[57] ABSTRACT

An archery peep sight adapted to be mounted on the bowstring of an archery bow for aligning the path of an arrow. A disc having a centrally located sight opening is attached to the bowstring in fixed space relation with the nocking point on the bowstring. The axis of the sight opening is coextensive with the axis of the disc and is located on the central plane of the disc. A frusto-conical surface is disposed inwardly from a first end of the disc, the apex thereof being terminated at the sight opening. A semi-conical recess is formed in the second end of the disc, the recess defining a horizontal planar surface adjacent the sight opening. Bowstring receiving channels are formed on opposite sides of the disc, the angular interval between a line normal to the bowstring receiving channels and the axis of the sight opening of the disc being in the range of 38°–50°.

7 Claims, 5 Drawing Figures

ARCHERY PEEP SIGHT

BACKGROUND OF THE INVENTION

1. Field of the Invention

The present invention generally relates to archery aids and, more particularly, to peep sights which aid in aligning the path of the arrow.

2. Prior Art

The prior art is replete with devices which have sought to improve archery techniques. In the construction of archery bows, it has been customary to equip the bowstring with both a nocking point and a peep sight spaced a predetermined distance on the bowstring above the nocking point. The structure of these activities is to provide a nocking point which insures the precise positioning of each arrow at the same point along the bowstring so that the arrow can be consistently drawn back in the same manner each time. In the construction of bows described in the prior art, it is conventional to attach the peep sight to the bowstring in spaced relation above the nocking point so as to be in the line of sight of the archer. The sights are typically affixed to the bowstring by separating the strands of the bowstring and inserting them into external grooves or channels which are formed along the periphery of and in the central plane of the peep sight. This construction insures that the peep sight will be snugly positioned within and along the central axis of the bowstring.

A problem with the sights which are disclosed in the prior art arises when the bowstring is drawn rearwardly. During the rearwardly pull of the bowstring, the peep sight will be rotated away from a vertical plane and have a tendency to become vertically misaligned with respect to the sight of the archer. This will occur even though the nocking point may prevent twisting or misalignment of the sight opening in a rotational direction about the axis of the bowstring. In addition, tipping the peep sight in an upwardly direction can create difficulties, particularly with those peep sights which are fabricated from a relatively flat unitary disc. Undesirable reflection or glare makes it difficult to sight through the peep sight and therefore makes it extremely hard to align the arrow with a target.

One of the devices which is taught by the prior art comprises a unitary disc having a sight opening therethrough which has its axis at an oblique angle to a line normal to the bowstring. Bowstring receiving channels are aligned along the central axis of the disc on opposite sides thereof. On the side of the sight opening nearest the target an expanded cylindrical recess is used. On the side of the sight opening nearest the archer, a second recessed portion is formed, the recessed portion being a generally elliptical surface of revolution. The sight axis of this device is defined by an angle of inclination with respect to an axis normal to the bowstring receiving channel which is substantially equal to the angle of displacement of the bowstring away from a vertical plane when the bowstring is drawn back into its cocked position. This device seeks to align the axis of the sight opening with the line of sight of the archer. In order to prevent any glare or light from interfering with the use of the sight, the device disclosed by the prior art incorporates a hood along the side of the disc adjacent the archer.

There are a number of problems inherent to the devices disclosed by the prior art. The complexity which arises in attempting to fabricate a sight which is dependent upon the angle of displacement of the bowstring is evident. In addition, by requiring the inclusion of hoods or other unsymmetrical protrusions upon the sight, it is clear that wind resistence and other imbalance factors will be created thereby deleteriously affecting the potential uses of the sight.

The present invention substantially resolves those problems existing in the devices taught by the prior art. The present invention comprises a unitary disc having parallel end faces with a circular sight opening disclosed along the central axis of the disc. A pair of parallel bowstring receiving channels are disposed obliquely through the periphery of the disc, the angular interval between the sight opening and the bowstring receiving channels being at a predetermined figure which will satisfy the objectives of the present invention. A frusto-conical recessed portion is disposed into the end of the disc adapted to be adjacent the archer. The apex of the conical portion lies at the sight opening. A semiconical recessed portion is disposed into the end of the disc adapted to be facing the target. The recessed portion includes a planar surface adapted to be horizontal when the peep sight is mounted on a bowstring, the ends of the planar surface being adjacent the termini of the bowstring receiving channels. The planar surface intersects the semiconical recessed portion adjacent the sight opening and eliminates reflection and glare when the present invention peep sight is mounted upon a bowstring.

SUMMARY OF THE INVENTION

The gist of the present invention is an archery peep sight which utilizes bowstring receiving channels which lie in a plane which is oblique with respect to the central plane of the body of the peep sight. The present invention comprises a disc which is cylindrical in form and has its end faces parallel to each other. A sight opening is disposed along the cylindrical axis of the disc and lies substantially on the center plane of the disc. A frusto-conical recess is disposed in the end face of the disc which is adapted to be adjacent the archer's eye.

A semiconical section is disposed into the opposite face in the same manner as the full conical recess. The portion of the semiconical section which is complementary to the full conical section is terminated by a planar surface which is perpendicular to the end faces of the disc, the planar surface being substantially adjacent the periphery of the sight opening.

Bowstring receiving channels are disposed into the periphery of the disc on opposite sides thereof at an oblique angle with respect to the plane of the disc. The terminus of the bowstring receiving channels adapted to be at the higher portion of the bowstring terminate at the ends of the planar surface of the semiconical section.

It is therefore an object of the present invention to provide an improved archery peep sight.

It is another object of the present invention to provide an archery peep sight which is independent of the displacement of the bowstring.

It is still another object of the present invention to provide an archery peep sight which includes a symmetrical, internal member for reducing light glare.

It is still yet another object of the present invention to provide an archery peep sight which is inexpensive and simple to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only and is not intended as a definition of the limits of the invention.

DESCRIPTION OF THE PRESENTLY PREFERRED EMBODIMENT

Figure 1:
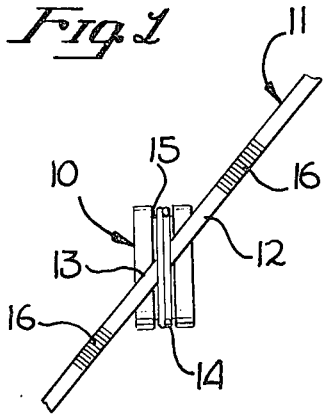
FIG. 1 is a side elevation view of the present invention archery peep sight mounted upon a bowstring illustrated in the drawn position.

An understanding of the present invention can be best gained by reference to FIG. 1 wherein a side elevation view of a mounted form of the present invention peep sight is shown, the sight being generally designated by the reference numeral 10. The present invention peep sight 10 is mounted upon bowstring 11 which is in turn mounted on a conventional archery bow which is not shown. Conventional archery bows which are in commercial use typically utilize a bowstring angle of displacement of approximately 28°. Although this figure can vary depending upon the length of the bow, the average draw length will produce a displacement of bowstring 11 which is in the order or 28° from a vertical plane.

Figure 2:
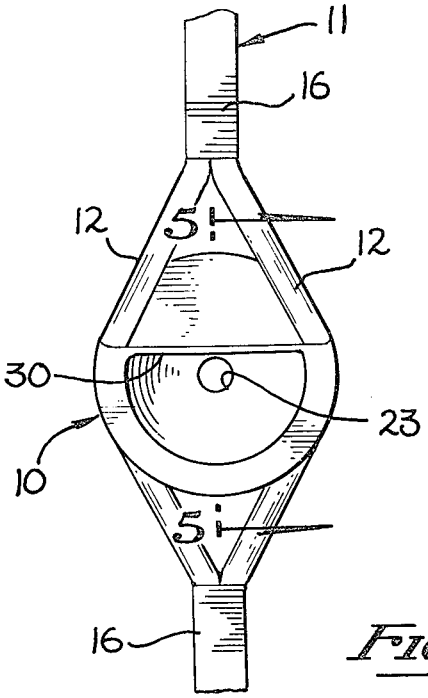
FIG. 2 is a front elevation view illustrating the face of the present invention archery peep sight which is directed toward the target.
Figure 3:
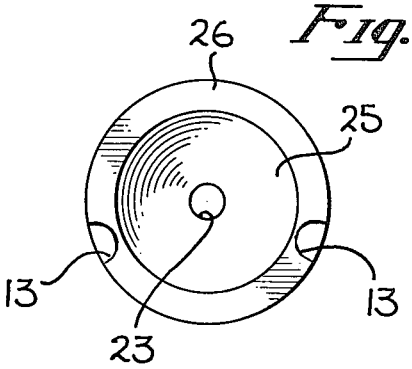
FIG. 3 is a rear elevation view of the present invention archery peep sight illustrating the end thereof which is directed towards the archer.

As can be best seen in FIG. 2, peep sight 10 is mounted upon bowstring 11 by separating the strands 12 of the bowstring 11 and inserting the separated strands 12 into bowstring receiving channels 13. Referring again to FIG. 1, peep sight 10 is secured between strand 12 by a conventional tie cord 14 which is disposed into peripheral channel 15 in a manner which will be described in detail hereinbelow. To firmly position peep sight 10 as shown in FIG. 1 and FIG. 2, bowstring 11 is wrapped above and below peep sight 10 by convolute windings 16. Windings 16 will insure that strands 12 do not separate any further than necessary to secure the present invention peep sight 10 in a proper position on bowstring 11.

A preferred embodiment of the present invention peep sight 10 comprises a cylindrical disc 20 which has complementary parallel faces 21 and 22. Circular sight opening 23 is disposed along cylindrical axis 24 of disc 20 and is disposed at the center plane of disc 20. Sight opening 23 is formed out of a portion of reduced thickness. The present invention archery peep sight 10 is adapted to be disposed on bowstring 11 with end face 21 adjacent the archer end face 22 being directed toward the target. Frusto-conical recess 25 is disposed into end face 21, the apex of conical recess 25 being at sight opening 23. Conical recess 25 is symmetrically disposed about cylindrical axis 24, the interference between conical recess 25 and end 21 leaving concentric rim 26 disposed thereabout.

Figure 4:
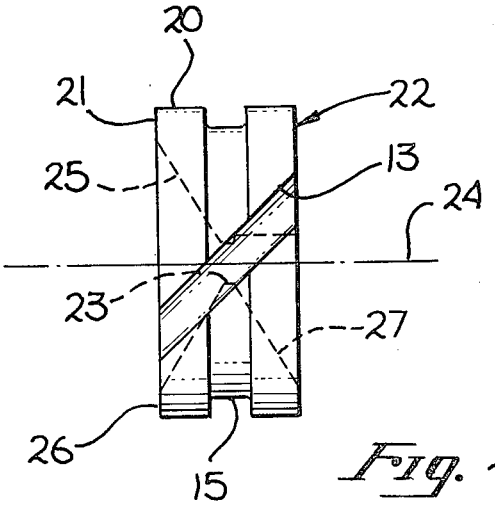
FIG. 4 is an enlarged side elevation view of the present invention archer peep sight.
Figure 5:
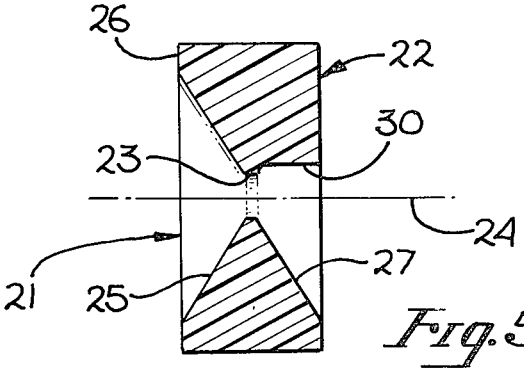
FIG. 5 is an enlarged, side elevation, cross-sectional view of the present invention archery peep sight taken through line 5—5 of FIG. 2.

Semiconical recess 27 is disposed into end face 22 as can be best seen in FIG. 2 and FIG. 4. The lower portion of semiconical recess 27 is complementary to the full conical recess 25. As with the case of conical recess 25, the apex of the conical revolution comprising semiconical recess 27 terminates at substantially the periphery of sight opening 23. The upper portion of cylindrical end face 22 is solid, and as can be best seen in FIG. 2, the terminus thereof is adapted to be parallel to a horizontal plane. Although the preferred embodiment of the present invention utilizes faces 21 and 22 in a parallel orientation with respect to each other, the relationship between the planes of faces 21 and 22 could be changed from parallel so long as the relationship between sight opening 23, and recesses 25 and 27 is not substantially altered.

Referring now to FIG. 4, a cross-sectional view of the present invention peep sight 10 is shown, the orientation thereof simulating the approximate position thereof when the peep sight 10 has been rotated into its position of use upon the cocking of the bowstring. The upper face of cylindrical end 22 is solid resulting in the formation of plane 30 which is directed toward the target. Although plane 30 is not parallel to a horizontal plane when the present invention peep sight 10 is being utilized, the rotation of plane 30 arising from the cocking of the bowstring will cause plane 30 to rotate downwardly and create an optical obstruction to shield sight opening 23 from unwanted glare or reflected light. One of the primary advantages of plane 30 is that it minimizes light glare or reflection without producing a structural imbalance which will affect the wind resistance of the sight during its use.

The present invention peep sight 10 does not require alignment of cylindrical axis 24 with the line of sight of the archer. As shown in FIG. 1, when bowstring 11 is cocked, it will have the effect of rotating peep sight 10 in a clockwise direction. Bowstring receiving channels 13 are disposed at an angle with respect to cylindrical and sight opening axis 24 as can be best seen in FIG. 4. Bowstring receiving channels 13 are disposed on either side of peep sight 10, the upper terminus thereof being substantially adjacent plane 30 (FIG. 2). When the present invention peep sight 10 is mounted upon bowstring 11, sight opening axis 24 will be inclined. The angular interval between the sight opening axis 24 and a line normal to bowstring receiving channels 13 will lie substantially in the range of 38° to 50° inclusive. The utilization of angular interval of 38° to 50° provides for proper rotation of peep sight 10 in a manner which will shade the outlet of sight opening 23 and permit the archer to accurately align the sight of the arrow being launched by bowstring 11.

The present invention peep sight 10 is preferably fabricated as a unitary structure, although other forms of construction can be utilized. The sight 10 can be fabricated from a suitably selected rigid or semi-rigid plastic or rubber or any other solid material such as aluminum which will provide for simple and inexpensive fabrication techniques. The form of the present invention sight 10 can also be altered from the preferred cylindrical profile to other suitable geometrical configurations such as an ellipse.

In use, the present invention peep sight 10 is positioned in predetermined spaced relation above the nocking point of bowstring 11. The peep sight 10 is mounted in accordance with that shown in FIG. 1 and FIG. 2 by separating the strands 12 of bowstring 11 and inserting the sight between strands 12 so that they will snugly engage bowstring receiving channels 13. Tie cord 14 securely positions peep sight 10 to strands 11, windings 16 precluding further separation of strands 12 of bowstring 11. When bowstring 11 is drawn to its cocked position, peep sight 10 will be rotated closing the angular interval between sight opening axis 24 and the target and also lowering plane 30 to effectively reduce any glare of reflected light which would inhibit the ability of the archer to align the flight of the arrow to the target. Minimal wind resistance caused by the symmetrical structure of peep sight 10 will preclude any disturbance of the arrow thereby improving the integral relationship between peep sight 10 and the archery bow.

I claim:

1. An archery peep sight for mounting upon an archery bowstring comprising a symmetrical member having first and second end faces in planes that are in parallel spaced relation to one another, a sight opening centrally disposed through said symmetrical member, the axis of said sight opening being perpendicular to each one of said planes of said symmetrical member, a first recessed portion being symmetrically disposed into said first end face, the apex of said first recessed portion said sight opening, a second recessed portion being disposed into said second end face and being including an end portion of complementary to a portion of said first recessed portions, said second recessed portion including a planar surface adjacent said sight opening and lying in a continuous plane extending in the general direction of the axis of the sight opening, the plane of said planar surface being perpendicular to the plane of said second end face, and a pair of parallel, archery bowstring receiving channels disposed on the periphery of said symmetrical member and intersecting the planes of said faces, the archery bowstring receiving channels being enagageable by separated portions of a single archery bowstring.

2. An archery peep sight as defined in claim 1 wherein said symmetrical member is cylindrical, and includes an annular channel disposed about the periphery thereof intermediate said end faces wherein said archery bowstring receiving channels intersect said annular channel on opposing sides of said cylindrical member.

3. An archery peep sight as defined in claim 2 further including a tie cord disposed in said annular channel whereby the portions of an archery bowstring are secured to said peep sight.

4. An archery peep sight as defined in claim 2 wherein said first recessed portion comprises a frusto-conical recess in said first end face, said frusto-conical recessed portion being concentric with and in surrounding relation to the sight opening, and being disposed on the side of said cylindrical member in a direction toward the archer when said cylindrical member is mounted on a bowstring.

5. An archery peep sight as defined in claim 4 wherein said second recessed portion comprises a partial conical section, said partial conical section being complementary to a portion of said first recessed portion in said first end face, said partial conical section being in surrounding relation to the sight opening on a side of said cylindrical member opposite to said first recessed portion.

6. An archery peep sight as defined in claim 2 wherein the angular interval between the axis of said sight opening and a line normal to the bowstring receiving channels is in the range of 38° to 50° inclusive.

7. An archery peep sight as defined in claim 2 wherein said bowstring receiving channels terminate at said second end face adjacent the termini of said planar surface.

* * * * *